US006708739B2

(12) United States Patent
Fabry

(10) Patent No.: US 6,708,739 B2
(45) Date of Patent: Mar. 23, 2004

(54) LABOR SAVING, HIGH SPEED, HIGH VOLUME, LIQUID FILLING MACHINE, FOR PALLETIZED CONTAINERS

(76) Inventor: Carl J. Fabry, 4566 N. Apopka Vineland Rd., Orlando, FL (US) 32818

( * ) Notice: Subject to any disclaimer, the term of this patent is extended or adjusted under 35 U.S.C. 154(b) by 0 days.

(21) Appl. No.: 10/435,266

(22) Filed: May 12, 2003

(65) Prior Publication Data

US 2003/0209283 A1 Nov. 13, 2003

Related U.S. Application Data

(60) Provisional application No. 60/379,405, filed on May 13, 2002.

(51) Int. Cl.[7] ..... B65B 1/04; B65B 3/04; B65B 37/00; B67C 3/00

(52) U.S. Cl. ..... 141/237; 141/231; 141/233; 141/270; 141/283; 141/284; 53/97; 53/110

(58) Field of Search ..... 141/231–233, 141/234, 237, 250, 266, 270, 283, 284, 248; 414/788.1, 789.9, 792.7; 53/79, 84, 97, 110

(56) References Cited

U.S. PATENT DOCUMENTS

| | | | | |
|---|---|---|---|---|
| 3,612,299 A | * | 10/1971 | Shaw et al. | 414/791.7 |
| 3,856,158 A | * | 12/1974 | Currie | 414/793.4 |
| 4,055,202 A | * | 10/1977 | Greene | 141/59 |
| 5,425,402 A | * | 6/1995 | Pringle | 141/235 |

* cited by examiner

*Primary Examiner*—Timothy L. Maust
(74) *Attorney, Agent, or Firm*—Sughrue Mion, PLLC

(57) ABSTRACT

A machine consisting of a vertically mobile liquid manifold filling system, and a horizontally mobile carriage for maneuvering pallets under a multi-head filler, for simultaneously filling entire pallet tiers of empty containers, such as 2.5 gallon metal or plastic jugs, bottles, or pails, 5.0 gallon metal or plastic jugs, bottles or pails, or 30–55 gallon metal or plastic drums, requires only the labor to lift and place empty containers onto a pallet, instead of the conventional physical handling and palletizing, of heavy, prefilled containers.

7 Claims, 1 Drawing Sheet

LABOR SAVING, HIGH SPEED, HIGH VOLUME, LIQUID FILLING MACHINE, FOR PALLETIZED CONTAINERS

This application claims benefit of Provisional Application No. 60/379,405 filed May 13, 2002; the disclosure of which is incorporated herein by reference.

BACKGROUND OF THE INVENTION

This invention relates to a labor saving, high speed, high volume liquid filling machine for larger containers that are to be palletized for shipment. Typically, most pallets of product are loaded to about 2,000–3,000 pounds, more or less, as would readily be handled by a forklift pallet moving and handling device. Typically, most shipping pallets are designed to be loaded two abreast in a commercial shipping vehicle, be it a truck, or a sea shipping container, with the maximum container or truck weight topping out at around 40,000 pounds, more or less. Assuming then, a liquid product with a specific gravity of 1.2, or 10 pounds per gallon, a pallet could contain 40–60 five gallon containers, each weighing 50 pounds, or 80 to 120 two and one half gallon containers, each weighing 25 pounds, or four 55 gallon drums, per pallet weighing 2,200 pounds, each assumption, having to handle, typically with labor, previously fill containers, represents a formidable, costly and laborious handling task.

Liquid filling machines are already known that efficiently fill containers, filled and weighted to then be handled in a separate process of palletization, but this invention combines both processes, improving on both aspects, by mass filling 16–25 containers, on a pallet tier simultaneously, which have been placed there on their empty weight, in less time than it typically takes to fill that same amount of containers, by conventional means, and by eliminating any further handling of these filled containers.

SUMMARY OF THE INVENTION

The present invention provides that a smaller labor force be required to package and ready for shipment, palletized liquid containers, at a lower cost. This is accomplished with the present invention by the described machine that maneuvers a pallet of empty light weight containers, tier by tier, in and out of the machine, filling all of them simultaneously and accurately, with a prescribed amount of fluid, until the desired number of tiers, and/or weight is achieved, all in a labor saving process.

BRIEF DESCRIPTION OF THE DRAWINGS

The FIGURE shows a preferred embodiment of the liquid filling apparatus of the present invention.

DETAILED DESCRIPTION OF THE INVENTION

Figure 1:
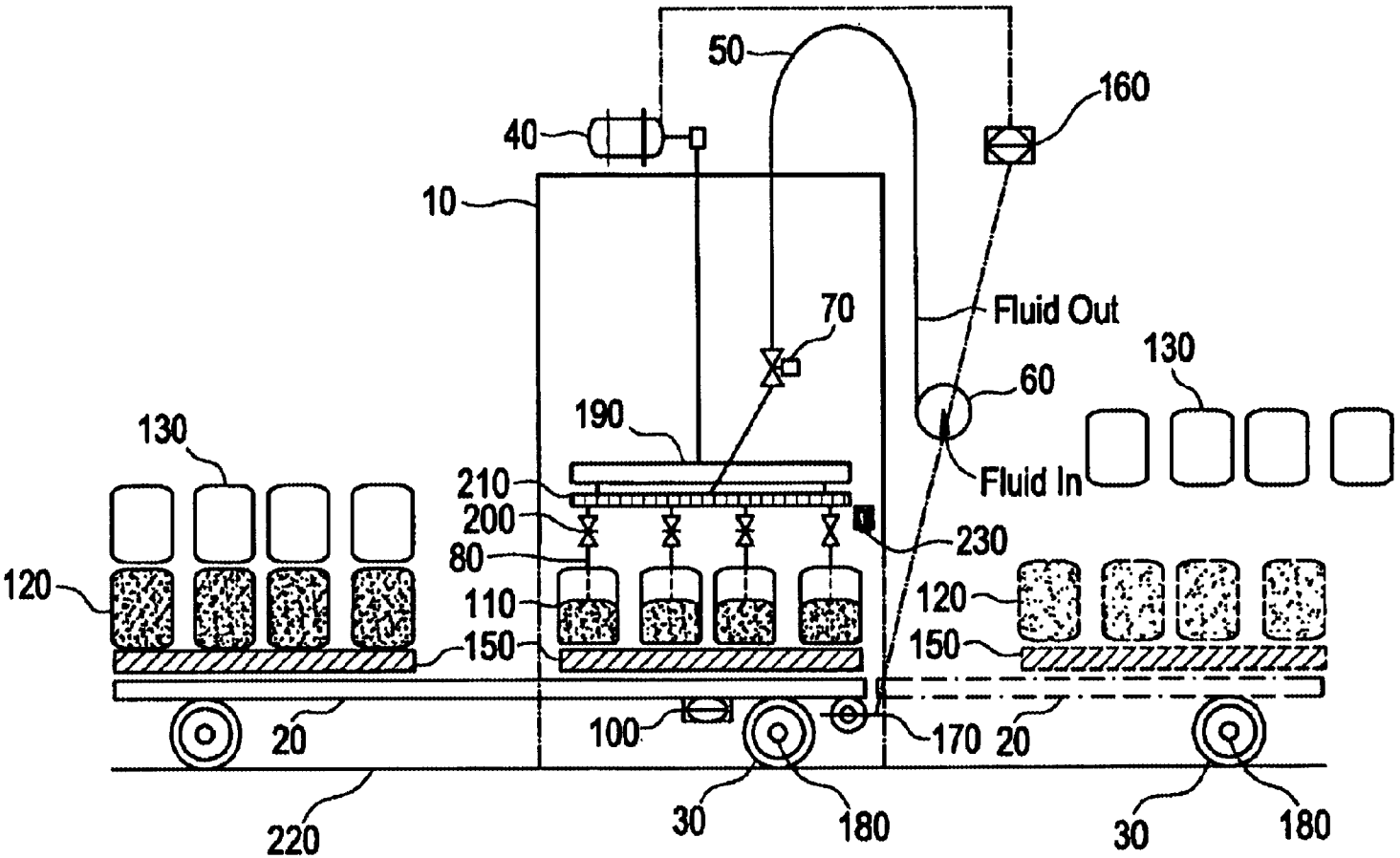

A fast, labor saving, high volume, liquid filling apparatus will now be described according to a preferred embodiment of the invention in conjunction with the FIGURE.

In the present invention, vertical and horizontal movements are integrated to achieve an efficient liquid filling apparatus.

A multidimensional, integrated frame 10, comprising a vertical and a horizontal phase is provided. A vertical elevator shaft and a horizontal track system is housed in the frame.

A reciprocating pallet transport system is provided for moving pallets of containers to be filled and capped, in and out, from under the elevator shaft. It includes a motorized and controlled wheeled carriage 20, riding on tracks, capable of holding two or more pallets 150. As illustrated in the FIGURE, the wheeled carriage 20 rides on carriage wheels 30, and automatically controlled as described in greater detail later.

A motorized and controllable vertical elevator 190 is provided within the elevator shaft of the frame 10. A pressurized boom and a multi-head nozzle apparatus 80, mounted on the elevator 190, is provided for filling individual containers 130 that are placed empty on the pallet 150. The pressurized boom and multi-head nozzle apparatus 80 includes metering valves 220, adjustable spouts 200 and a manifold 210 for plumbing.

A pumping system is provided. Although the fluid source is not shown in the FIGURE, it supplies liquid to a fluid pump 60, through a flexible fluid feed hose 50, and through a fluid control valve 70. Thus, a bulk solution from a holding tank is accurately and precisely pumped and dispensed into the containers on the pallet 150, as indicated by the partially filled containers 110.

Overhead mounting brackets for air operated container cap closure devices are also provided (not shown). After the containers 110 are filled with a predetermined quantity of the bulk liquid, they are capped accordingly, by an automated, motorized multi-pail lid fastening device.

Electrical and automation control panels are provided for the carriage 20, the elevator 190, the pump 60, the manifold 210 and the air operated closure devices. Thus, the present invention provides a fast, labor saving, high volume, liquid filling apparatus.

The movement of the carriage 20 is automated by use of a hydraulic pump 170 which controls a hydraulic carriage motor 180 in the wheel 30. A carriage control sensor 100 is connected to the hydraulic pump 170, for sending control signals to the hydraulic pump 170 so that the movement of the carriage frame 20 is accurately controlled.

In addition, the movement of the elevator 190 is automated by an elevator motor 40 via a cable. A microprocessor 160 sends a control signal to the elevator motor 40 to control movements of the elevator 190 to coordinate with the dispensing of liquid in the containers. An elevator control sensor 90 is provided for sensing vertical position of the elevator 190 and facilitates the automation of the elevator motor 40.

According to the present invention, a high output metering system is provided with the fluid pump which feeds the nozzle filling apparatus 200 for each container 110 and is controlled on a time basis, through plumbing and the manifold 210 designed for low friction loss, for the uniform and precise feeding of individual drops, for each individual container 110, on the tier of the pallet 150 being filled, and in a precise manner checked with pump starting and stopping, coupled with air operated start/stop valves, through specifically and similarly sized and pressurized metering orifice plates.

In other embodiments of the invention, the high output metering system is controlled on a weight basis, a metered basis, or a gravity fill basis.

As illustrated, the reciprocating movement of the carriage frames 20 allows one pallet 150 to be undergoing a filling procedure while another pallet 150 which holds filled containers 120, receives a second tier of empty containers 130 on top. Thus, new tiers of empty containers are placed on top of the tiers having filled containers, so that the reciprocating movement of the carriage frame 20 provides a constant supply of empty containers under the pressurized boom and multi-head nozzle apparatus 80.

As each tier is received in the frame 10, the elevator 190 housing the liquid filling assembly precisely raises and stops the liquid filling assembly above the next tier of empty containers, while simultaneously and precisely inserting a filling tube into each container.

Since the carriage system transports at least two pallets of containers back and forth under the elevated liquid filling system, while one pallet of empty containers is being filled, the other pallet is moved out from under the filler and exposed so that caps or lids can be placed on the recently filled containers, and a new or subsequent tier of empty containers 130 placed on top of the completed containers 120, is ready to be transported, back under the filler. The process repeats until a completed pallet with a desired number of tiers of containers is filled, capped and readied for shipment.

In the nozzle filling system of the present invention, when the pressure through a high pressure metering orifice for each container is reduced by exiting through a larger diameter of looped tubing, entry pressure into the container being filled is reduced, thus, eliminating foaming of the product for rapid filling.

Thus, in the present invention, an entire pallet of containers can be filled and as it is automatically moved away from the dispensing system, another pallet of containers can be moved under the dispensing system and filled. With this movement, one pallet can be receiving caps or another tier of empty containers while another pallet is being filled, thus, providing for an efficient operation.

Moreover, this apparatus reduces the amount of labor required by an operator because the pallets of containers are moved under the dispenser by an automated device, and the associated vertical elevation of the dispenser is automated so as to facilitate the filling of subsequent tiers of pallets of containers with reduced physical labor by the operator.

While only certain embodiments of the invention have been specifically described herein, it will be apparent that numerous modifications may be made without departing from the concept and scope of the invention.

What is claimed is:

1. A liquid filling apparatus, comprising:

a frame including an elevator shaft;

an elevator housed in said frame;

a horizontal track system housed in said frame for supporting a carriage system;

a reciprocating pallet transport system carried by said carriage system, for holding and moving at least one tier of pallets of containers to be filled and capped;

a pressurized boom and a multi-head nozzle apparatus mounted on the elevator so as to be elevated to a predetermined position for filling the containers on the pallets;

a pumping system for pumping and filtering a bulk solution from a holding tank through the pressurized boom and multi-head nozzle apparatus and into the containers on the pallets;

overhead mounting brackets for air operated container cap closure devices;

an automated, motorized multi-lid fastening device for the air operated closure devices; and electrical and automation control panels for the carriage, the elevator, the pump, the manifold and air operated closure devices.

2. A liquid filling apparatus according to claim 1, wherein the pumping system feeds a nozzle apparatus which includes a nozzle for each container, and the nozzle apparatus is controlled on a time basis, through plumbing and manifold designed for low friction loss, for the uniform and precise feeding of individual drops, for each container, on a tier of the pallet being filled, checked with pump starting and stopping, coupled with air operated start/stop valves, though specifically and similarly sized pressurized metering orifice plate.

3. A liquid filling apparatus according to claim 1, wherein the pumping system feeds a nozzle apparatus which includes a nozzle for each container, and the nozzle apparatus is controlled on a weight basis, through plumbing and manifold designed for low friction loss, for the uniform and precise feeding of individual drops, for each container, on a tier of the pallet being filled, checked with pump starting and stopping, coupled with air operated start/stop valves, though specifically and similarly sized pressurized metering orifice plate.

4. A liquid filling apparatus according to claim 1, wherein the pumping system feeds a nozzle apparatus which includes a nozzle for each container, and the nozzle apparatus is controlled on a metered basis, through plumbing and manifold designed for low friction loss, for the uniform and precise feeding of individual drops, for each container, on a tier of the pallet being filled, checked with pump starting and stopping, coupled with air operated start/stop valves, though specifically and similarly sized pressurized metering orifice plate.

5. A liquid filling apparatus according to claim 1, wherein the pumping system feeds a nozzle apparatus which includes a nozzle for each container, and the nozzle apparatus is controlled on a gravity fill basis, through plumbing and manifold designed for low friction loss, for the uniform and precise feeding of individual drops, for each container, on a tier of the pallet being filled, checked with pump starting and stopping, coupled with air operated start/stop valves, though specifically and similarly sized pressurized metering orifice plate.

6. A liquid filling apparatus according to claim 1, wherein the elevator controls the vertical position of the pressurized boom and multi-head nozzle apparatus to be above a tier of empty containers, while simultaneously and precisely inserting a filling tube into each of the containers.

7. A liquid filling apparatus according to claim 1, wherein the carriage system reciprocatingly transports at least two pallets of containers back and forth under the elevated pressurized boom and multi-head nozzle apparatus, so that while one pallet of empty containers is being filled, another pallet holding recently filled containers is horizontally displaced away from under the pressurized boom and multi-head nozzle apparatus, so as to be exposed so that caps or lids can be placed on the recently filled containers, and a new or subsequent tier of empty containers is placed on top of the capped containers, ready to be moved back under the pressurized boom and multi-head nozzle apparatus, wherein the process repeats until a completed pallet with a desired number of tiers of containers is filled, capped and readied for shipment.

* * * * *